US009411260B2

(12) United States Patent
Mitsui et al.

(10) Patent No.: US 9,411,260 B2
(45) Date of Patent: Aug. 9, 2016

(54) IMAGE FORMING APPARATUS HAVING DEVELOPING BIAS AND SUPPLY BIAS APPLICATION UNITS

(71) Applicant: CANON KABUSHIKI KAISHA, Tokyo (JP)

(72) Inventors: Yoshihiro Mitsui, Numazu (JP); Kodai Hayashi, Suntou-gun (JP); Shuhei Kawasaki, Susono (JP); Naoki Fukushima, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/641,826

(22) Filed: Mar. 9, 2015

(65) Prior Publication Data

US 2015/0261123 A1 Sep. 17, 2015

(30) Foreign Application Priority Data

Mar. 14, 2014 (JP) ..... 2014-052466

(51) Int. Cl.
*G03G 15/08* (2006.01)
*G03G 15/06* (2006.01)

(52) U.S. Cl.
CPC ..... *G03G 15/065* (2013.01); *G03G 15/0808* (2013.01); *G03G 2215/0132* (2013.01)

(58) Field of Classification Search
CPC ..... G03G 15/065; G03G 15/0808
USPC ..... 399/55, 281, 285
See application file for complete search history.

(56) References Cited

U.S. PATENT DOCUMENTS 4,378,158 A * 3/1983 Kanbe ..... G03G 15/0808 399/281 X
5,365,318 A * 11/1994 Hiraoka ..... G03G 15/065 399/281
6,134,397 A * 10/2000 Shimazaki ..... G03G 15/0808 399/281
7,067,225 B2 * 6/2006 Watanabe ..... G03G 15/08 399/281 X (Continued)

FOREIGN PATENT DOCUMENTS

JP 2008-090160 A 4/2008
JP 2010-160236 A 7/2010

(Continued)

OTHER PUBLICATIONS

Machine translation of JP 2010-160236 (published on Jul. 22, 2010) printed on Aug. 25, 2015.*

(Continued)

*Primary Examiner* — Sophia S Chen
(74) *Attorney, Agent, or Firm* — Fitzpatrick, Cella, Harper & Scinto

(57) ABSTRACT

An image forming operation for forming an image on one recording material includes a developing bias application unit applying a developing bias to a developer bearing member and a supply bias application unit applying a supply bias to a developer supply member. At the start of image formation, an absolute value of the developing bias is greater than an absolute value of the supply bias, and in a center or latter half of the image formation period, the developing bias and the supply bias have equal potential, and then the absolute value of the developing bias becomes smaller than the absolute value of the supply bias, until the end of image formation.

17 Claims, 7 Drawing Sheets

(56) References Cited

U.S. PATENT DOCUMENTS

| | | | | |
|---|---|---|---|---|
| 7,221,892 | B2 * | 5/2007 | Sato | G03G 15/0808 399/281 X |
| 7,912,390 | B2 | 3/2011 | Mitsui | |
| 7,957,658 | B2 | 6/2011 | Mitsui | |
| 8,155,539 | B2 | 4/2012 | Kawasaki et al. | |
| 8,548,344 | B2 | 10/2013 | Mitsui | |
| 2001/0028816 | A1 * | 10/2001 | Kakeshita | G03G 15/0806 399/281 |
| 2013/0287450 | A1 * | 10/2013 | Hayashi | G03G 15/0808 399/281 |
| 2013/0287451 | A1 * | 10/2013 | Yamamoto | G03G 15/0808 399/281 |
| 2013/0287452 | A1 * | 10/2013 | Yoshida | G03G 15/0808 399/281 |
| 2013/0287453 | A1 | 10/2013 | Mitsui et al. | |
| 2013/0308988 | A1 * | 11/2013 | Hirukawa | G03G 15/0808 399/281 |

FOREIGN PATENT DOCUMENTS

| | | | |
|---|---|---|---|
| JP | 2013-228584 | A | 7/2013 |
| JP | 2013-228636 | A | 11/2013 |

OTHER PUBLICATIONS

Yoshihiro Mitsui et al., U.S. Appl. No. 14/640,606, filed Mar. 6, 2015.
Kodai Hayashi et al., U.S. Appl. No. 14/641,816, filed Mar. 9, 2015.

* cited by examiner

IMAGE FORMING APPARATUS HAVING DEVELOPING BIAS AND SUPPLY BIAS APPLICATION UNITS

BACKGROUND OF THE INVENTION

1. Field of the Invention

The present invention relates to an image forming apparatus.

2. Description of the Related Art

An electrophotographic apparatus or an electrostatic recording apparatus (hereinafter, an image forming apparatus) such as a copying machine, a printer, or a facsimile includes a developing assembly for visualizing an electrostatic latent image using a non-magnetic single-component toner. Conventionally, a developing assembly which includes a developing roller as a developer bearing member for bearing and conveying toner and a supply roller disposed around the developing roller and serving as a developer supply member for supplying toner to the developing roller is known. In this developing assembly, toner is supplied to the developing roller while being triboelectrically charged by mechanical rubbing between the supply roller and the developing roller. The supplied toner, of which the thickness of a toner layer on the developing roller is regulated to a predetermined amount by a developer regulating member, is conveyed to a developing zone near a photosensitive drum, which is an electrostatic latent image bearing member, and the electrostatic latent image is visualized as a toner image.

Toner which remains on the developing roller without being used for development in the developing zone (hereinafter referred to as a "residual developing toner") is scraped off the developing roller by mechanical rubbing between the supply roller and the developing roller in a contact region contacting the supply roller. Simultaneously with this, toner is supplied from the supply roller to the developing roller. On the other hand, the scraped toner is mixed with toner present inside and near the supply roller.

Conventionally, depending on a printing pattern during an image formation period in such a developing assembly, a phenomenon in which a halftone density immediately after a background portion is different from a halftone density (hereinafter referred to as a "development ghost") immediately after solid print may occur. The development ghost occurs due to a difference in toner charge amount which results from a difference in printing pattern and is likely to occur when the supply roller has low scraping performance.

In particular, in a developing assembly in which the respective surfaces of a developing roller and a supply roller rotate in the same direction in the contact region therebetween (called a "co-rotating developing assembly" below) as in Japanese Patent Application Publication No. 2013-228584, there have been cases where development ghost has occurred in marked fashion due to the weak mechanical stripping action of the supply roller.

In this case, in order to reduce image density non-uniformity in the leading end portion of the image, there are examples in which the biases applied respectively to the developing roller and the supply roller differ between the front half portion and the latter half portion of the development of the first page of paper after a print preparation operation of the developing roller, as disclosed in Japanese Patent No. 5062183. The problem in Japanese Patent No. 5062183 is that in the first page of paper after the print preparation operation, in particular, the density is high during one revolution of the developing roller from the leading end of the image, and becomes weaker thereafter.

SUMMARY OF THE INVENTION

Here, the problem which arises in a co-rotating developing assembly such as that Japanese Patent Application Publication No. 2013-228584 is development ghost (called "development positive ghost" below) in which the amount of toner developed from the developing roller becomes relatively greater and the density becomes relatively darker, in "after-black" toner, compared to "after-white" toner. Even if the bias control in Japanese Patent No. 5062183 is applied in respect of problems such as development positive ghost in the co-rotating developing assembly, there are cases where development ghost of a poor level occurs, and the problem is not eliminated. More specifically, there is a difference between the occurrence of development positive ghost of a poor level, not only in the first sheet of paper after a print preparation operation of the developing roller, which is the conditions indicated to give rise to image density non-uniformity in Japanese Patent No. 5062183, but also in the second and subsequent sheets of continuous printing.

This difference is caused by the fact that the problem in the developing assembly in Japanese Patent No. 5062183 is caused by non-uniformities in the toner supply amount from the supply roller 5 to the developing roller 4, whereas the problem of development positive ghost in the co-rotating developing assembly is caused by the weak force which mechanically strips away the development residue toner. More specifically, in the case of Japanese Patent No. 5062183, the level of the toner supply non-uniformity is affected by conditions such as whether or not the paper is the first sheet after the print preparation operation. In one co-rotating developing assembly, regardless of these conditions, since the force for mechanically stripping away the development residue toner is weak, then development positive ghost of a poor level also occurs in the second and subsequent sheets of continuous printing.

From the foregoing, the problems of density non-uniformity and development positive ghost in the co-rotating developing assembly of Japanese Patent No. 5062183 vary depending on the occurring phenomenon, the conditions of occurrence, and the causes of the occurrence.

When measures are undertaken to strengthen the mechanical stripping force of the supply roller in this co-rotating developing assembly, although the development ghost is reduced, the mechanical rubbing between the developing roller and the supply roller is increased, and therefore degradation of the toner is promoted. As toner degradation, in other words, the separation and embedding of additives on the surface of the toner, progresses, this leads to increase in the degree of agglomeration and decline in charging performance, and problems arise, such as toner filming in which melt adhesion of the toner onto the surface of the developing roller occurs, and increase in the lifespan of the developing assembly is prevented. Therefore, it is necessary to suppress the occurrence of development ghost by a method other than that of mechanical rubbing.

Furthermore, a conceivable countermeasure involves suppressing the occurrence of development ghost by changing the bias between the developing roller and the supply roller and controlling the bias in such a manner that the development residue toner is stripped away from the developing roller by electrostatic force. However, in a co-rotating developing assembly, the surfaces of the developing roller and the supply roller both rotate in the same direction, and therefore the mechanical supply force due to rubbing between the developing roller and the supply roller is weak. Therefore, when a bias for stripping away the development residue toner is applied, there are cases where image defects due to an insufficiency in the amount of supplied toner (called "solid image compliance defects" below) arise when high-density printing, such as a full-page solid image, is carried out.

The object of the present invention is to provide an image forming apparatus compatible with high image quality and long lifespan, whereby both reduction in development ghost and suppression in solid image compliance defects can be achieved, in the case of using a developing assembly in which the respective surfaces of a developing roller and a supply roller move in the same direction in a contact region.

In order to achieve the object described above, there is provided an image forming apparatus forming an image on a recording material, comprising:

a developer bearing member that bears a developer and develops an electrostatic latent image formed on an image bearing member to form a developer image when a developing bias is applied thereto;

a developing bias application unit that applies a developing bias to the developer bearing member;

a developer supply member that is provided so as to make contact with the developer bearing member and supplies a developer to the developer bearing member when a supply bias is applied thereto; and a supply bias application unit that applies a supply bias to the developer supply member, the image forming apparatus being configured such that the developer bearing member and the developer supply member move in the same direction in a contact region where the members contact each other, wherein during an image formation period from a start of image formation until an end of image formation in an image forming operation for forming an image on one recording material, the developing bias application unit applies a developing bias to the developer bearing member and the supply bias application unit applies a supply bias to the developer supply member so that, at the start of image formation, the absolute value of the developing bias is greater than the absolute value of the supply bias, and in the exact center or the latter half of the image formation period, the developing bias and the supply bias have equal potential, whereupon the absolute value of the developing bias becomes smaller than the absolute value of the supply bias, until the end of image formation.

In order to achieve the object described above, there is provided an image forming apparatus forming an image on a recording material, comprising:

a developer bearing member that bears a developer and develops an electrostatic latent image formed on an image bearing member to form a developer image when a developing bias is applied thereto;

a developing bias application unit that applies a developing bias to the developer bearing member;

a developer supply member that is provided so as to make contact with the developer bearing member and supplies a developer to the developer bearing member when a supply bias is applied thereto; and a supply bias application unit that applies a supply bias to the developer supply member, the image forming apparatus being configured such that the developer bearing member and the developer supply member move in the same direction in a contact region where the members contact each other, wherein during an image formation period from a start of image formation until an end of image formation in an image forming operation for forming an image on one recording material, the developing bias application unit applies a developing bias to the developer bearing member and the supply bias application unit applies a supply bias to the developer supply member such that a biasing force causing the developer to move from the developer supply member towards the developer bearing member increases gradually and acts on the developer in the region of contact between the developer bearing member and the developer supply member.

In order to achieve the object described above, there is provided an image forming apparatus, comprising:

a developer bearing member that forms a developer image by developing an electrostatic latent image formed on an image bearing member; and a developer supply member that supplies a developer to the developer bearing member, the image forming apparatus being configured such that the developer bearing member and the developer supply member move in the same direction in a contact region where the members contact each other, wherein during an image formation period from a start of image formation until an end of image formation in an image forming operation for forming an image on one recording material, a developing bias is applied to the developer bearing member and a supply bias is applied to the developer supply member, such that, at the start of image formation, the absolute value of the developing bias is greater than the absolute value of the supply bias, and in the exact center or the latter half of the image formation period, the developing bias and the supply bias have equal potential, whereupon the absolute value of the developing bias becomes smaller than the absolute value of the supply bias, until the end of image formation.

In order to achieve the object described above, there is provided a process cartridge, comprising:

a developer bearing member that forms a developer image by developing an electrostatic latent image formed on an image bearing member; and a developer supply member that supplies a developer to the developer bearing member, the process cartridge being configured such that the developer bearing member and the developer supply member move in the same direction in a contact region where the members contact each other, wherein during an image formation period from a start of image formation until an end of image formation in an image forming operation for forming an image on one recording material, a developing bias is applied to the developer bearing member and a supply bias is applied to the developer supply member, such that, at the start of image formation, the absolute value of the developing bias is greater than the absolute value of the supply bias, and in the exact center or the latter half of the image formation period, the developing bias and the supply bias have equal potential, whereupon the absolute value of the developing bias becomes smaller than the absolute value of the supply bias, until the end of image formation.

According to the present invention, it is possible to achieve both reduction of development ghost and prevention of solid image compliance defects which occur when using a developing assembly in which the respective surfaces of a developing roller and a supply roller move in the same direction in a contact region. Therefore, it is possible to provide an image forming apparatus which is compatible with high image quality and long lifespan.

Further features of the present invention will become apparent from the following description of exemplary embodiments with reference to the attached drawings.

DESCRIPTION OF THE EMBODIMENTS

An embodiment of the invention is described in concrete detail below on the basis of practical examples, with reference to the drawings. However, the dimensions, materials, shape and relative arrangement of the constituent components described in this embodiment may be changed as appropriate in accordance with the configuration and various conditions of the apparatus to which the invention is applied. In other words, the range of this invention is not limited to the embodiments described below.

Embodiment

Image Forming Apparatus

Figure 1:
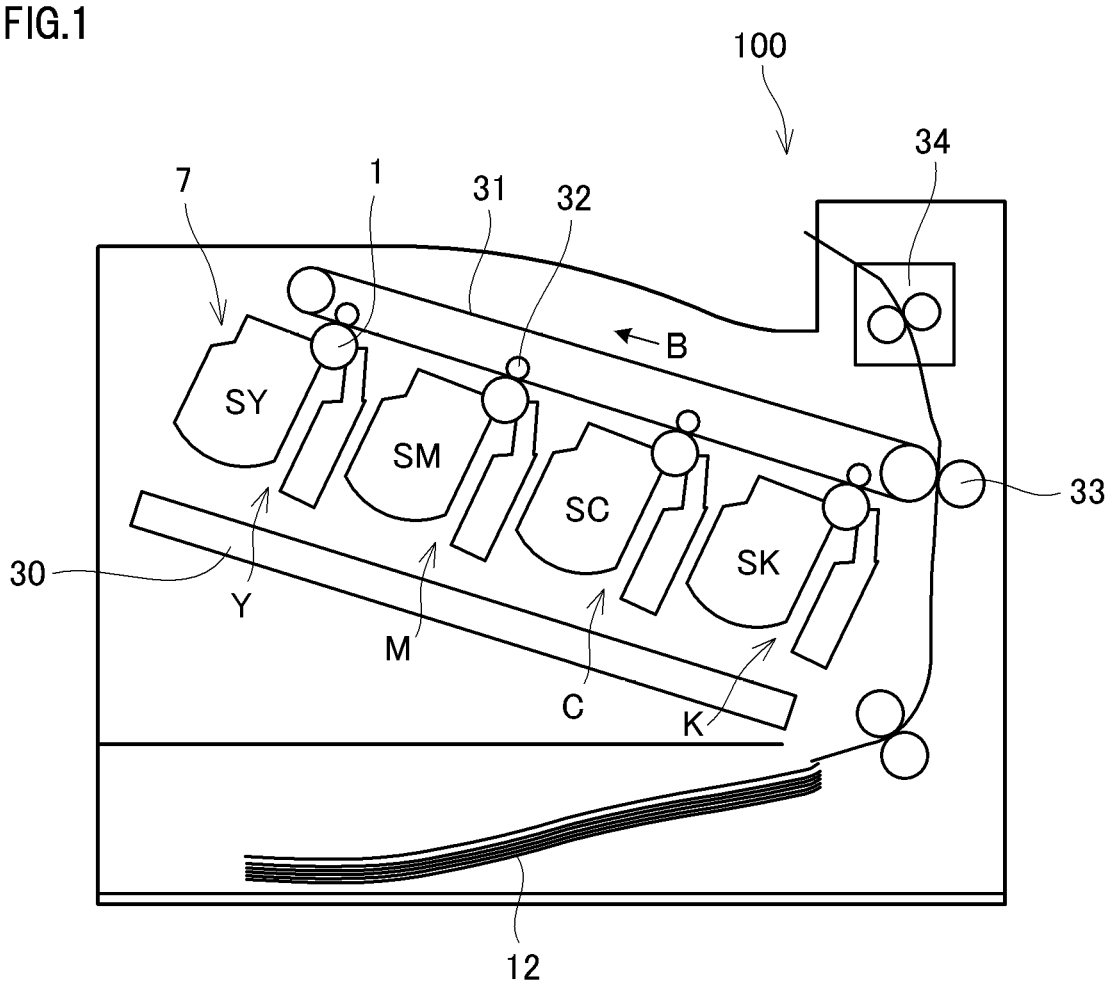
FIG. 1 is a general cross-sectional diagram of an image forming apparatus relating to practical examples of the present invention.

An overall configuration of an electrophotographic image forming apparatus (image forming apparatus) according to an embodiment of the present invention will be described with reference to FIG. 1. FIG. 1 is a schematic cross-sectional view of an image forming apparatus 100 according to the present embodiment. In the present embodiment, a case where the present invention is applied to a full-color laser beam printer which employs an in-line system and an intermediate transfer system will be described as an example of an image forming apparatus. The image forming apparatus 100 can form a full-color image on a recording material (for example, recording paper, a plastic sheet, and a cloth) according to image information. The image information is input to the main body of the image forming apparatus from an image reading apparatus which is connected to the image forming apparatus, or from a host device, such as a personal computer, which is connected in a communicable fashion with the main body of the image forming apparatus.

In the image forming apparatus 100, process cartridges 7 as a plurality of image forming units include image forming units SY, SM, SC, and SK for forming images of the respective colors yellow (Y), magenta (M), cyan (C), and black (K), respectively. In the present embodiment, the image forming units SY, SM, SC, and SK are arranged in line in a direction across a vertical direction. Moreover, the process cartridges 7 of the respective colors have the same shape and store toner of the respective colors yellow (Y), magenta (M), cyan (C), and black (K), respectively. A process cartridge for black which is more frequently used may have a larger size than the other process cartridges.

The process cartridge 7 is detachably attachable to an image forming apparatus body (hereinafter an apparatus body) by means of a mounting unit such as a mounting guide and a positioning member disposed in the apparatus body. Here, the apparatus body is an apparatus constituent part excluding at least the process cartridge 7 from the constituent parts of the image forming apparatus 100. The developing assembly 3 may be solely detachably attached to the apparatus body, and in this case, an apparatus constituent part excluding the developing assembly 3 from the constituent parts of the image forming apparatus 100 may be referred to as the apparatus body.

A photosensitive drum (image bearing member) 1 is driven to be rotated by a driving unit (driving source) (not illustrated). A scanner unit (exposure apparatus) 30 is disposed around the photosensitive drum 1. The scanner unit 30 is an exposure unit that emits laser based on image formation to form an electrostatic image (electrostatic latent image) on the photosensitive drum 1. Laser exposure in a main scanning direction (a direction orthogonal to a conveying direction of the recording material 12) is started from a position signal called a BD signal from a polygon scanner in respective scan lines. On the other hand, in a sub-scanning direction (the conveying direction of the recording material 12), the laser exposure is performed with a predetermined delay from a TOP signal generated from a switch (not illustrated) disposed in a conveying path of the recording material 12. In this way, laser exposure can be performed always at the same position on the photosensitive drum 1 in the four process stations Y, M, C, and K.

An intermediate transfer belt 31 as an intermediate transfer member for transferring a toner image (developer image) on four photosensitive drums 1 to the recording material 12 is disposed so as to face the photosensitive drums. The intermediate transfer belt 31 formed of an endless belt as an intermediate transfer member circulates (rotates) in the direction indicated by arrow B (counterclockwise) while making contact with all photosensitive drums 1. Four primary transfer rollers 32 as a primary transfer unit are arranged in parallel on an inner circumference side of the intermediate transfer belt 31 so as to face the respective photosensitive drums 1. A bias having a polarity opposite to the normal charging polarity of toner is applied to the primary transfer roller 32 from a primary transfer bias power source (high-voltage power source) as a primary transfer bias application unit (not illustrated). In this way, the toner image on the photosensitive drum 1 is transferred (primarily transferred) to the intermediate transfer belt 31.

Moreover, a secondary transfer roller 33 as a secondary transfer unit is disposed on an outer circumference side of the intermediate transfer belt 31. A bias having a polarity opposite to the normal charging polarity of toner is applied to the secondary transfer roller 33 from a secondary transfer bias power source (high-voltage power source) as a secondary transfer bias application unit (not illustrated). In this way, the toner image on the intermediate transfer belt 31 is transferred (secondarily transferred) to the recording material 12. For example, when a full-color image is formed, the above-described processes are sequentially performed in the image forming units SY, SM, SC, and SK, whereby the toner images of respective colors on the intermediate transfer belt 31 are primarily transferred in a sequentially superimposed manner. After that, the recording material 12 is conveyed to a secondary transfer unit in synchronization with the movement of the intermediate transfer belt 31. The four-color toner images on the intermediate transfer belt 31 are collectively secondarily transferred to the recording material 12 by the action of the secondary transfer roller 33 which is in contact with the intermediate transfer belt 31 with the recording material 12 interposed.

The recording material 12 having the toner image transferred thereto is conveyed to a fixing apparatus 34 as a fixing unit. The fixing apparatus 34 applies heat and pressure to the recording material 12 whereby the toner image is fixed to the recording material 12. After that, the recording material 12 having the toner image fixed thereto is discharged to a sheet discharge tray provided on an upper surface of the apparatus body.

[Process Cartridge]

Figure 2:
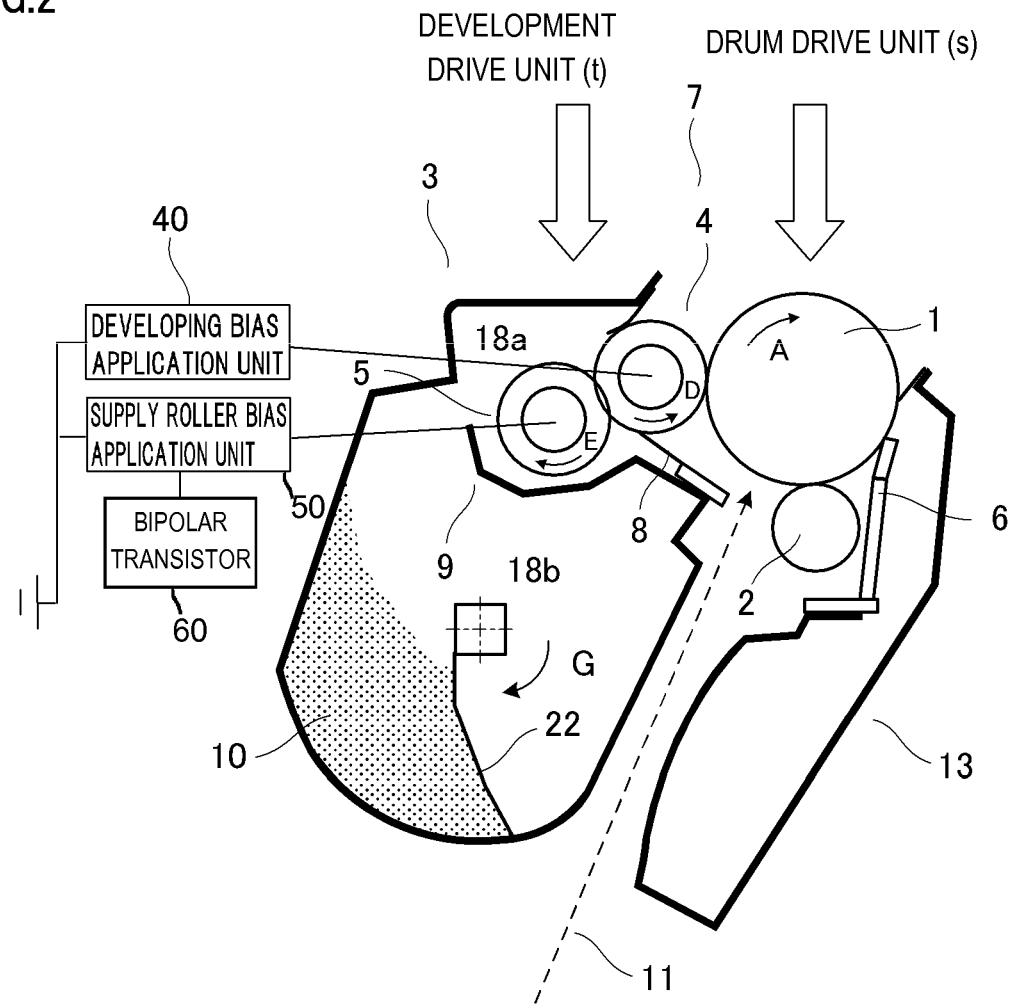
FIG. 2 is a general cross-sectional drawing of a process cartridge relating to Examples of the present invention.

An overall configuration of the process cartridge 7 mounted on the image forming apparatus 100 according to the present embodiment will be described with reference to FIG. 2. FIG. 2 is a cross-sectional view (a main cross-sectional view) schematically illustrating a cross-section perpendicular to the longitudinal direction (the direction of the rotation axis) of the photosensitive drum 1 of the process cartridge 7 according to the present embodiment. In the present embodiment, the configurations and the operations the process cartridges 7 of the respective colors are substantially the same except the types (colors) of developer stored therein.

The process cartridge 7 includes a photosensitive unit 13 of a drum drive unit (s) having the photosensitive drum 1 and the like and a developing unit 3 of a development drive unit (t) having the developing roller 4 and the like. The photosensitive drum 1 is rotatably attached to the photosensitive unit 13 with a bearing (not illustrated) interposed. The photosensitive drum 1 is driven to be rotated in the direction indicated by arrow A according to an image forming operation by receiving driving force of a driving motor as a photosensitive drum driver A. Moreover, a charging roller 2 and a cleaning member 6 are disposed in the photosensitive unit 13 so as to make contact with the circumferential surface of the photosensitive drum 1. A bias sufficient for loading a desired charge on the photosensitive drum 1 is applied to the charging roller 2 from a charging bias power source (high-voltage power source) as a charging bias application unit (not illustrated). In the present embodiment, the application bias is set such that a potential (charging potential: Vd) on the photosensitive drum 1 is −500 V. The photosensitive drum 1 charged by the charging roller 2 is irradiated with a laser beam 11 from the scanner unit 30 based on the image information, whereby an electrostatic image (electrostatic latent image) is formed on the photosensitive drum 1.

On the other hand, the developing unit 3 includes a developing chamber 18*a* and a developer accommodating chamber 18*b*. The developer accommodating chamber 18*b* is disposed under the developing chamber 18*a*. Toner 10 as a developer is stored in the developer accommodating chamber 18*b*. Moreover, a developer conveying member 22 for conveying the toner 10 to the developing chamber 18*a* is provided in the developer accommodating chamber 18*b*. The developer conveying member 22 rotates in the direction indicated by arrow G to thereby convey the toner to the developing chamber 18*a*. In the present embodiment, a toner having a negative normal charging polarity is used as the toner 10, and in the following description, it is assumed that a negative-charging toner is used. However, the toner that can be used in the present invention is not limited to a negative-charging toner, and a positive-charging toner having a positive normal charging polarity may be used depending on an apparatus configuration.

A developing roller 4 as a developer bearing member that makes contact with the photosensitive drum 1 and rotates in the direction indicated by arrow D by receiving a driving force from a driving motor as a development driver (not illustrated) is provided in the developing chamber 18*a*. In the present embodiment, the developing roller 4 and the photosensitive drum 1 rotate so that the respective surfaces move in the same direction at the facing portions (contacting portions). Moreover, a bias sufficient for developing and visualizing the electrostatic latent image on the photosensitive drum 1 as a toner image is applied to the developing roller 4 from a developing roller bias power source (high-voltage power source) 40 as a developing roller bias application unit (developing bias application unit).

A toner supply roller (hereinafter, called supply roller) 5 which rotates in the direction of arrow E in the drawing, and a toner amount regulating member (hereinafter called regulating member) 8, are also disposed in the developing chamber 18*a*. The supply roller (developer supply member) 5 is a roller for supplying toner conveyed from the developer accommodating chamber 18*b*, to the developing roller 4, and the regulating member 8 regulates the amount of toner supplied by the supply roller 5 which is coated onto the developing roller 4 and applies an electric charge to the toner. The supply roller 5 and the developing roller 4 contact each other so as to form a nip region, and also rotate respectively in such a manner that the surfaces thereof move in the same direction as each other in the contact region.

Next, the configuration of the developing roller 4, the supply roller 5 and the regulating blade (developer amount regulation member) 8 are described in detail.

The developing roller 4 used has a diameter of 15 mm, and is formed by a base layer of silicone rubber on a 6 mm-diameter conductive core, and a surface of urethane rubber formed on top of the base layer. It is possible to use a developing roller 4 having a volumetric resistance of $10^4$ to $10^{12}\Omega$.

The supply roller 5 has a diameter of 15 mm, and is an electroconductive elastic sponge roller in which a foamed layer is formed on the outer circumference of a 6 mm-diameter conductive core, and the supply roller used may have a volumetric resistance of $10^4$ to $10^8\Omega$. The resistance value of the supply roller 5 which is used in the present practical example is $4\times10^{-6}\Omega$ and the hardness thereof is 200 gf. The hardness of the supply roller 5 in the present practical example is a value obtained by measuring the load at which a flat plate having a longitudinal direction of 50 mm enters by 1 mm from the surface of the supply roller 5.

The regulating blade 8 is a metallic SUS sheet steel blade having a thickness of 0.1 mm, which is disposed in such a manner that a free end thereof contacts the developing roller 4 on the upstream side in terms of the direction of rotation of the developing roller. The regulating blade 8 used in the present practical example is a blade formed by cutting the front end of an SUS plate metal from the side of the surface which contacts the developing roller. The front end portion of the developing roller is bent in the cutting direction by the cutting process, and the amount of bend of the front end, which corresponds to the radius of curvature, is 0.02 mm.

The developing roller 4 receives the supply of a bias which is sufficient to develop the electrostatic latent image on the photosensitive drum 1 and thereby make the image visible, from a developing roller bias power source (high-voltage power source) 40 which constitutes developing roller bias application unit (developing bias application unit). Furthermore, a bias is supplied to the supply roller 5 from a supply roller bias power source (high-voltage power source) 50 which constitutes supply roller bias application unit (supply bias application unit). The supply roller bias power source 50 has a high-voltage configuration which applies a voltage divided from a high-voltage power source of the charging bias via a high-speed bipolar transistor 60. By adopting a high-voltage configuration of this kind, it is possible to carry out high-speed switching of the supply roller bias. Consequently, even in cases where the print speed of the image forming apparatus is high, it is possible for the supply bias to be varied in accordance with the print speed. The values of the developing bias and the supply bias in the present practical example are described below.

In this case, if the value obtained by subtracting the bias applied to the developing roller 4 from the bias applied to the supply roller 5 is of the same polarity as the normal charging polarity of the toner, then a force acts in a direction to bias the toner in the contact region between the supply roller 5 and the developing roller 4, from the supply roller 5 and towards the developing roller 4. Conversely, if the value obtained by subtracting the bias applied to the developing roller 4 from the value of the bias applied to the supply roller 5 is of the opposite polarity to the normal charging polarity of the toner, then a force acts in a direction to bias the toner from the developing roller 4 towards the supply roller 5. For example, if the developing bias is −400V and the supply bias is −500V, then the difference therebetween is −100V, and the toner is biased from the supply roller 5 to the developing roller 4. The details of the biasing force that acts on the toner are described below.

The toner which is supplied to the developing roller 4 by the supply roller 5 enters into the contact region between the regulating member 8 and the developing roller 4, due to the rotation of the developing roller 4 in the direction of arrow D. The toner which has infiltrated into the contact region is triboelectrically charged by the rubbing between the surface of the developing roller 4 and the regulating member 8, and the thickness of this layer is regulated while simultaneously applying an electric charge thereto. The toner on the developing roller 4 of which the layer thickness has been regulated is conveyed to a region opposing the photosensitive drum 1 by the rotation of the developing roller 4, and the electrostatic latent image on the photosensitive drum 1 is developed and made visible as a toner image.

The residual toner which is not used for development in the developing zone on the developing roller 4 (called "development residue toner" below) enters into the contact region with the supply roller 5 due to the rotation of the developing roller 4. A portion of the development residue toner is collected onto the supply roller 5 due to the mechanical rubbing between the developing roller 4 and the supply roller 5, and the potential difference between the developing roller 4 and the supply roller 5, and the toner inside the supply roller 5 is mixed with the peripheral toner. On the other hand, the toner which remains on the developing roller 4 rather than being collected on the supply roller 5 is imparted with an electric charge by the rubbing with the supply roller 5, while being mixed with the toner newly supplied from the supply roller 5.

[Biasing Force Acting on Toner]

Figure 7:
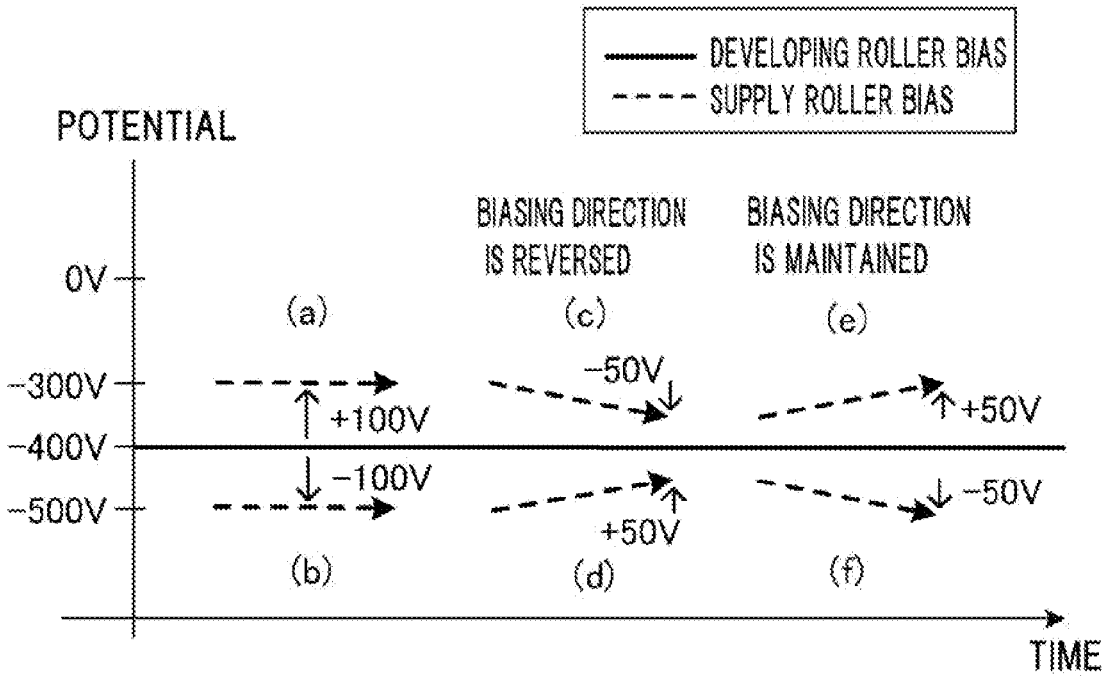
FIG. 7 is a schematic drawing illustrating a relationship between the potential difference of a bias and toner adhesion force.

Referring to FIG. 7, the biasing force acting on the toner in the contact region between the supply roller 5 and the developing roller 4 will be described. FIG. 7 illustrates various patterns (a) to (f) of a supply roller bias and a developing roller bias which change with time, in which the vertical axis represents potential and the horizontal axis represents time. Here, a force that biases toner to either the supply roller 5 or the developing roller 4 acts on the toner in the contact region between the supply roller 5 and the developing roller 4 depending on a magnitude relation between the bias applied to the supply roller 5 and the bias applied to the developing roller 4.

[[When Bias Potential Difference is Constant]]

The direction in which the biasing force acting on toner acts on the supply roller 5 or the developing roller 4 is determined by the polarity of a value obtained by subtracting the value of the bias applied to the developing roller 4 from the value of the bias applied to the supply roller 5. That is, the toner biasing direction is determined by the polarity of the difference of the potential of the supply roller bias from the potential of the developing roller bias. When the polarity of the bias potential difference is the same as the normal charging polarity of the toner, force that biases toner from the supply roller 5 to the developing roller 4 acts on the toner in the contact region (Pattern (b)). In contrast, when the polarity of the bias potential difference is opposite to the normal charging polarity of the toner, force that biases toner from the developing roller 4 to the supply roller 5 acts on the toner in the contact region (Pattern (a)).

Specifically, as in Pattern (a) of FIG. 7, when the developing roller bias is −400 V and the supply roller bias is −300 V, the bias potential difference is (−300 V)−(−400 V)=+100 V and has a positive polarity. When the normal charging polarity of toner is negative, since the polarity of the bias potential difference is opposite to the normal charging polarity of toner, force that biases toner from the developing roller 4 to the supply roller 5 acts on the toner.

On the other hand, as in Pattern (b) of FIG. 7, when the developing roller bias is −400 V and the supply roller bias is −500 V, the bias potential difference is (−500 V)−(−400 V)=−100 V and has a negative polarity. When the normal charging polarity of toner is negative, since the polarity of the bias potential difference is the same as the normal charging polarity of toner, force that biases toner from the supply roller 5 to the developing roller 4 acts on the toner.

Moreover, the larger the bias potential difference between the supply roller 5 and the developing roller 4, the larger the magnitude of the biasing force acting on the toner. Both the force that biases toner to the supply roller 5 and the force that biases toner to the developing roller 4 act on the toner in the contact region, and the bias potential difference indicates the difference in the magnitude of both forces. That is, among the forces acting on the toner, a more dominant one of the force that biases toner to the supply roller 5 and the force that biases toner to the developing roller 4 is determined by the polarity and the magnitude of the potential difference between the supply roller 5 and the developing roller 4. Thus, when the potential difference is zero, the two biasing forces compete each other, and as a result, the biasing force acting on the toner becomes zero.

[[When Bias Potential Difference Changes]]

The above-described phenomenon occurs when the values of applied biases are constant (that is, when the bias potential difference is constant). On the other hand, when the value of the bias changes, and thus, the bias potential difference changes (during a period where the bias potential difference is changing), the direction of biasing force acting on toner changes depending on the way in which the bias potential difference changes.

For example, when the bias potential difference is gradually changed to such a magnitude that the force that biases toner from the supply roller 5 to the developing roller 4 strengthens, the force that holds the toner inside the supply roller 5 weakens whereas the force that supplies the toner inside the supply roller 5 to the developing roller 4 strengthens. With this, of the toner present inside and on the surface of the supply roller 5, toner which is highly sensitive to a potential difference starts being gradually supplied to the developing roller 4. That is, when the bias potential difference changes in such a way that the magnitude of biasing force of which the direction is determined by its polarity decreases, biasing force in the direction opposite to the direction determined by the polarity becomes dominant regardless of the polarity and the magnitude of the bias potential difference at that time-point. As a result, the direction of the biasing force acting on toner is reversed (Patterns (c) and (d)).

As in Pattern (c) of FIG. 7, when the developing roller bias is constant at −400 V whereas the supply roller bias changes from −300 V to −350 V in a predetermined period, the bias potential difference changes from +100 V to +50 V. That is, the bias potential difference (the magnitude of supply bias) is changed by −50 V with the elapse of time and the polarity of a change (inclination) per unit time is negative. When the normal charging polarity of toner is negative, this change occurs in such a way that the magnitude of the biasing force that biases toner from the developing roller 4 to the supply roller 5 due to the positive polarity opposite to the polarity of toner decreases gradually. Thus, as the force acting on the toner during the period where the bias potential difference is changing, the biasing force that biases toner in the direction opposite to the direction determined by the positive polarity (the direction from the supply roller 5 to the developing roller 4 due to the negative polarity) is dominant. As a result, biasing force in the direction corresponding to the negative polarity acts on the toner regardless of the fact that the bias potential difference has a positive polarity.

Similarly, as in Pattern (d) of FIG. 7, when the developing roller bias is constant at −400 V whereas the supply roller bias changes from −500 V to −450 V in a predetermined period, the bias potential difference changes from −100 V to −50 V. That is, the bias potential difference (the magnitude of supply bias) is changed by +50 V with the elapse of time and the polarity of a change (inclination) per unit time is positive. When the normal charging polarity of toner is negative, this change occurs in such a way that the magnitude of the biasing force that biases toner from the supply roller 5 to the developing roller 4 due to the same negative polarity as the polarity of toner decreases gradually. Thus, as the force acting on the toner during the period where the bias potential difference is changing, the biasing force that biases toner in the direction opposite to the direction determined by the positive polarity (the direction from the developing roller 4 to the supply roller 5 due to the positive polarity) is dominant. As a result, biasing force in the direction corresponding to the positive polarity acts on the toner regardless of the fact that the bias potential difference has a negative polarity.

On the other hand, when the bias potential difference changes in such a way that the magnitude of biasing force of which the direction is determined by its polarity increases, the biasing force becomes more dominant, and the direction of the biasing force acting on toner does not change but is maintained (Patterns (e) and (f)).

As in Pattern (e) of FIG. 7, when the developing roller bias is constant at −400 V whereas the supply roller bias changes from −350 V to −300 V in a predetermined period, the bias potential difference changes from +50 V to +100 V. That is, the bias potential difference (the magnitude of supply bias) is changed by +50 V with the elapse of time and the polarity of a change (inclination) per unit time is positive. When the normal charging polarity of toner is negative, this change occurs in such a way that the magnitude of the biasing force that biases toner from the developing roller 4 to the supply roller 5 due to the positive polarity opposite to the polarity of toner increases gradually. Thus, the force acting on the toner during the period where the bias potential difference is changing maintains the toner biasing direction determined by the positive polarity, and this biasing force becomes more dominant.

Similarly, as in Pattern (f) of FIG. 7, when the developing roller bias is constant at −400 V whereas the supply roller bias changes from −450 V to −500 V in a predetermined period, the bias potential difference changes from −50 V to −100 V. That is, the bias potential difference (the magnitude of supply bias) is changed by −50 V with the elapse of time and the polarity of a change (inclination) per unit time is negative. When the normal charging polarity of toner is negative, this change occurs in such a way that the magnitude of the biasing force that biases toner from the supply roller 5 to the developing roller 4 due to the same negative polarity as the polarity of toner increases gradually. Thus, the force acting on the toner during the period where the bias potential difference is changing maintains the toner biasing direction determined by the negative polarity, and this biasing force becomes more dominant.

[Mechanism of Occurrence of Development Ghost]

Next, the mechanism behind the occurrence of development ghost will be described. Development ghost occurs due to the fact that the amount of charge on the toner on the developing roller after one revolution in which virtually all of the toner on the developing roller 4 has been developed (hereinafter, this toner is called "after-black") is different to the amount of charge on the toner on the developing roller in a non-printing part (hereinafter, this toner is called "after-white"). The amount of charge is different on the after-white and the after-black toners because of the different number of times that each has undergone triboelectric charging. The after-black toner on the developing roller 4 is consumed as supplied on the developing roller 4, and therefore has an amount of charge acquired by triboelectric charging one time between the regulating blade 8 and the supply roller 5. On the other hand, in the after-white toner, triboelectric charging between the supply roller 5 and the developing roller 4, and triboelectric charging by the regulating blade 8, are both applied to the development residue toner which has been charged previously. Due to this difference in the number of times of triboelectric charging, the amount of charge on the after-white toner tends to be higher than the amount of charge on the after-black toner.

The image pattern used to determine the development ghost level in the present practical example is a pattern in which a solid patch image is printed, which is a single-surface half-tone image having a measurement density of 0.6 according to an X-Rite Spectrodensitometer 500 after one revolution of the developing roller. In the half-tones after one revolution of the developing roller which has printed a solid patch image using the present image pattern, in other words, in the position corresponding to after-black toner, the amount of charge on the toner on the developing roller is relatively low. Consequently, on account of developing γ characteristics, in a half-tone section, development ghost (called "development positive ghost" below) occurs, in which the amount of toner developed from the developing roller is relatively large and the density becomes relatively darker, in the after-black toner, compared to the after-white toner.

Due to the mechanism described above, in order to prevent development ghost, provided that it is possible to increase the amount of development residue toner that is collected by being stripped away by the supply roller 5, then the amounts of charge on the after-white and the after-black toners can be brought closer to each other. If the amounts of charge on the after-white and the after-black toners can be brought closer to each other, then development ghost can be improved.

Here, in the co-rotating developing assembly used in the present practical example, the force which mechanically strips off and collects the development residue toner is weak compared to a developing assembly in which the surfaces of the developing roller 4 and the supply roller 5 rotate in mutually opposite directions (hereinafter, called a "counter-rotating developing assembly"), and therefore a large amount of development residue toner remains. If a large amount of development residue toner remains, then the triboelectric charge on the after-white toner tends to becomes higher. When measures are undertaken to strengthen the mechanical stripping force of the supply roller, in a co-rotating developing assembly, although the development ghost is reduced, the mechanical rubbing between the developing roller and the supply roller is increased, and therefore degradation of the toner is promoted. As toner degradation, in other words, the separation and embed of additives on the surface of the toner, progresses, this leads to increase in the degree of agglomeration and decline in charging performance, and problems arise, such as toner filming in which melt adhesion of the toner onto the surface of the developing roller occurs, and increase in the lifespan of the developing assembly is prevented. Therefore, it is necessary to suppress the occurrence of development ghost by a method other than that of mechanical rubbing.

Furthermore, a conceivable countermeasure involves suppressing the occurrence of development ghost by changing the bias between the developing roller and the supply roller and controlling the bias in such a manner that the development residue toner is stripped away from the developing roller by electrostatic force. However, in a co-rotating developing assembly, the surfaces of the developing roller and the supply roller both rotate in the same direction, and therefore the mechanical supply force due to rubbing between the developing roller and the supply roller is weak. Therefore, when a bias for stripping away the development residue toner is applied, there are cases where image defects due to an insufficiency in the amount of supplied toner (called "solid image compliance defects" below) arise when high-density printing, such as a full-page solid image, is carried out.

With the foregoing in view, a method of reducing the occurrence of development ghost by increasing the amount of residual developing toner collected by the supply roller 5 while preventing solid image compliance defects is required. In the present embodiment, this can be accomplished by controlling the potential difference between the developing roller 4 and the supply roller 5. In the practical examples (Examples) given below, the details and the effects of the control are described by using comparative examples.

Example 1

Control of Supply Roller Bias

Figure 3:
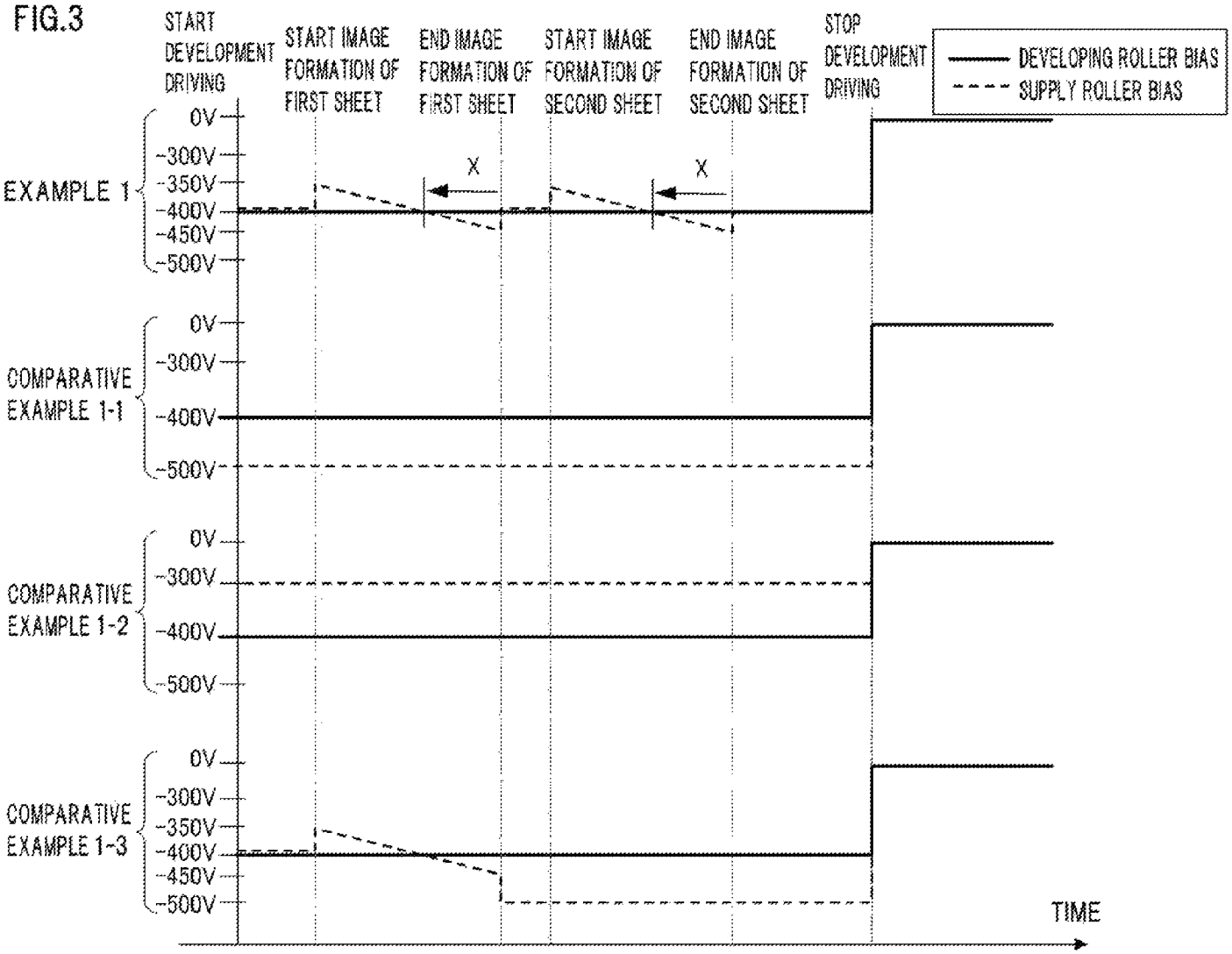
FIG. 3 is a timing chart of voltage control in Example 1 of the present invention.

The bias control between the developing roller 4 and the supply roller 5 in a first practical example (Example 1) of the present invention is described here with reference to FIG. 3. FIG. 3 is a timing chart showing a comparison of the bias control in the case of continuous printing of a plurality of sheets (in this case two sheets), between Example 1 and comparative example 1.

Here, respective time-points in the timing chart will be described in detail. The following time-points are the time-points during printing (image forming operation) of one sheet of recording material.

The time-point "start of development driving" is a time-point at which the developing roller 4 and the supply roller 5 receive the driving force of the driving motor as the development driver B and start rotating.

The time-point "start of image formation" is a time-point at which laser exposure in the sub-scanning direction starts.

The time-point "end of image formation" is a time-point at which the laser exposure in the sub-scanning direction ends.

The time-point "stopping of development driving" is a time-point at which the driving motor as the development driver B stops and the rotation of the developing roller 4 and the supply roller 5 stops.

However, the respective time-points are not limited to those described above as long as the time-points occur within the printing (image forming operation) of one sheet of recording material. For example, the time-point "start of image formation" may be set to occur a predetermined period earlier than the time-point at which the laser exposure in the sub-scanning direction starts. Moreover, the time-point "end of image formation" may be set to occur a predetermined period later than the time-point at which the laser exposure ends, for example. The respective time-points may be changed so as to be optimized depending on the configuration of the developing assembly and the image forming apparatus.

The bias applied to the developing roller 4 is constant during a period from "start of development driving" to "end of development driving," and in the present example, −400 V is applied. The developing bias is not necessarily controlled to be constant. Furthermore, in the present Example, the bias applied to the supply roller 5 is controlled in such a manner that the potential difference between the developing roller 4 and the supply roller 5 is an equal potential from the "start of development driving" until the "start of image formation" (this is called "pre-rotation" below).

When the bias control during pre-rotation involves controlling the bias in a direction which biases the toner from the developing roller 4 towards the supply roller 5, then the amount of toner on the developing roller 4 which is stripped away and collected during pre-rotation is increased. Consequently, an effect is obtained in that the development ghost in the vicinity of the leading edge of the image is further improved, at equal potential as the present Example. Furthermore, even if the bias control during pre-rotation is a bias acting in a direction to impel the toner from the supply roller 5 towards the developing roller 4, an effect is obtained in that development ghost is improved in comparison with a fixed bias on the supply side as in comparative example 1-1 described below.

Furthermore, in the present Example, the potential difference between the developing roller 4 and the supply roller 5 is also controlled to equal potential, between the sheets of media during continuous printing (called "inter-sheet" below) as well. In other words, when forming an image on a plurality of recording media in continuous fashion, the developing bias and the supply bias are controlled to equal potential during the period from the image formation end of the image formation operation of the preceding recording material, until the image formation start of the image formation operation of the following recording material.

Figure 5:
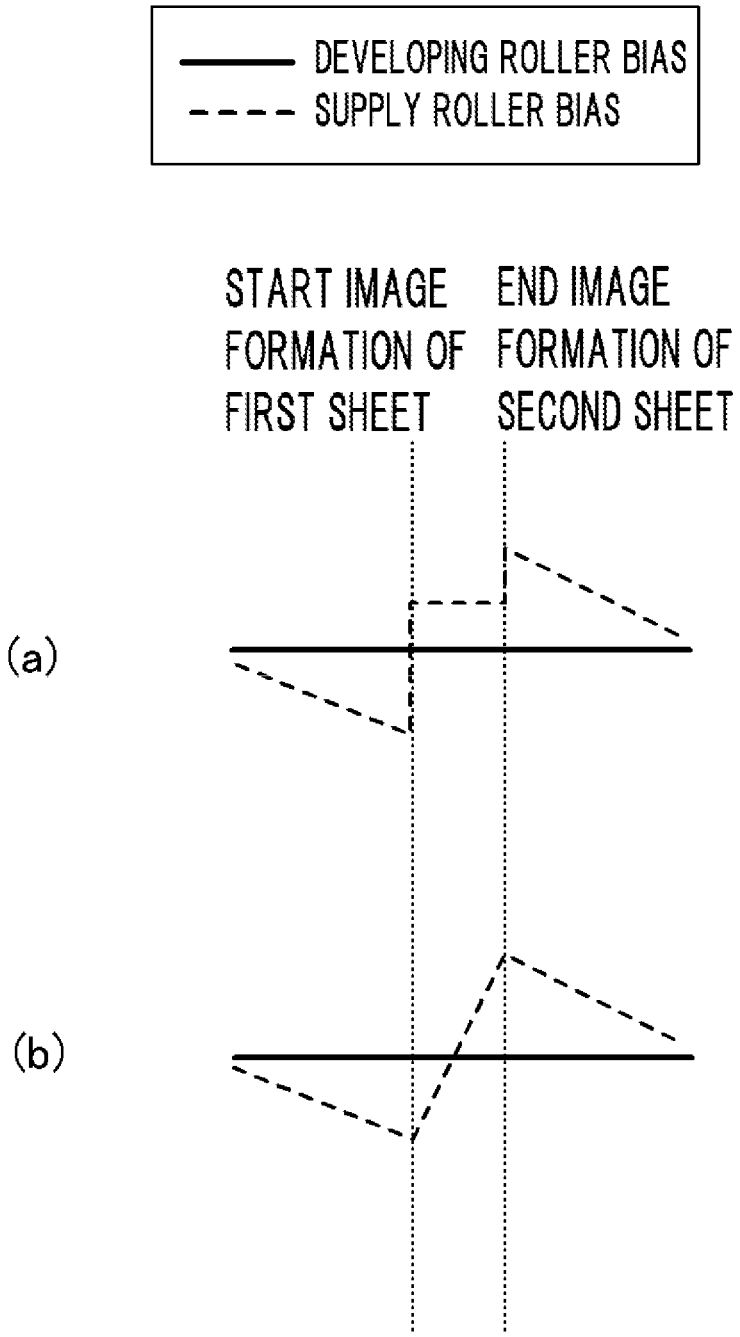
FIG. 5 is a timing chart of a modification example of voltage control in Example 1 of the present invention.

When the inter-sheet bias control involves controlling the bias in a direction which biases the toner from the developing roller 4 towards the supply roller 5, then the amount of toner on the developing roller 4 which is stripped away and collected between sheets is increased. Consequently, an effect is obtained in that the development ghost in the vicinity of the leading end of the image in the second and subsequent sheets is further improved, at the equal potential as the present Example. FIG. 5 shows a concrete control example. (a) in FIG. 5 corresponds to (a) in FIG. 7. Furthermore, (b) in FIG. 5 corresponds to a combination of patterns (d) and (e) in FIG. 7. The control procedure is not limited to that shown in FIG. 5, and control involving various combinations of patterns (a), (d) and (e) in FIG. 7 may also be implemented.

Furthermore, even if the inter-sheet bias control is a bias in a direction to bias the toner from the supply roller 5 towards the developing roller 4, an effect is obtained in that development ghost is improved in comparison with a fixed bias as in comparative example 1-1 described below. Although concrete control examples are not described here, control based on patterns (b), (c) and (f) in FIG. 7 or involving various combinations thereof may be implemented.

Next, the supply bias control during image formation on one sheet will be described. From "start of image formation" until "end of image formation", control is implemented to maintain the gradient of the bias applied to the supply roller 5, and to gradually increase the bias in a direction which biases the toner from the supply roller 5 towards the developing roller 4. Furthermore, in the present Example, a position where the relative relationship of magnitude between the absolute values of the supply bias and the developing bias is reversed during the period of image formation on one sheet, in other words, a position where the developing bias and the supply bias have equal potential (equipotential position). The equipotential position of the developing bias and the supply bias is either in the central portion of the image in the conveyance direction (the exact center of the image formation period or the center or exact center of the recording material in the conveyance direction), or at a distance X from the trailing end in the trailing part of the paper with respect to the central portion. In the present Example, the equipotential position is the central portion of the image in the conveyance direction. In other words, the supply bias control according to the present Example is control which combines the patterns (c) and (f) in FIG. 7 on either side of the position where the developing bias and the supply bias have equal potential. Control of this kind is control in which the toner holding force of the supply roller 5 is weakened little by little from the leading end towards the trailing end of the image. By this control, an action is obtained in which the large amount of toner held on the supply roller 5 by a stripping collecting bias in the front half portion of the image is released with respect to the latter end of the image. Due to this action, it is possible to ensure a stable toner supply amount to the developing roller 4 up to the trailing end of the image, compared to a case where a stripping collecting bias of a fixed value is applied from the leading end to the latter end of the image.

Furthermore, in the latter half portion of the image, a sufficient potential difference is provided between the developing roller 4 and the supply roller 5, and therefore a toner supply amount of a sufficient amount is supplied to the developing roller 4. As a result of this, even in cases where, for example, a high-density printing image, such as a full page solid image, is provided, it is possible to present an image of high quality, without the occurrence of solid image compliance defects due to insufficiency in the supplied amount of toner.

From the foregoing, by the supply roller bias control according to the present Example, it is possible to suppress solid image compliance defects, while controlling the supply bias in a direction of stripping collecting of the development residue toner. Consequently, it is possible to suppress increase in the amount of charge on the after-white toner during image formation, and the development ghost can be improved by reducing the difference between the amount of charge on the after-white toner and the amount of charge on the after-black toner. In the present Example, control is implemented to change the amount of change per unit time in the bias applied to the supply roller 5 during image formation (called the "supply bias gradient" below), to a uniform gradient, but the supply bias gradient may be changed in varying fashion.

Figure 4:
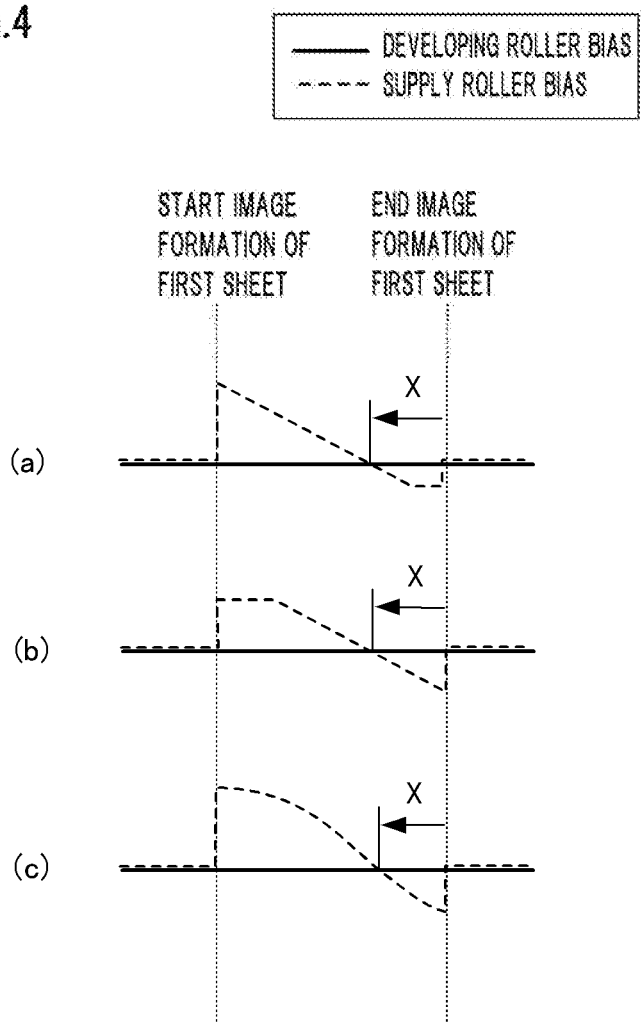
FIG. 4 is a timing chart of a modification example of voltage control in Example 1 of the present invention.

FIG. 4 shows a modification example of the pattern of the supply bias control in the present Example. (a) in FIG. 4 is a control example in which the pattern (f) in FIG. 7 is switched to the pattern (b), after passing the equipotential position X. (b) in FIG. 4 is a control example which adopts pattern (a) of FIG. 7 in the prescribed time period after start of image formation, and thereafter starts the supply bias control (patterns (c) and (f) in FIG. 7) in the present Example. The supply bias gradient is not limited to being changed only one time and may be changed a plurality of times. (c) in FIG. 4 is a control example in which the supply bias gradient is changed continuously (in step-wise fashion) in such a manner that the change in the bias traces a sinusoidal curve. These are merely examples, and the control pattern is not limited to these examples.

Experiment

Here, an experiment carried out in order to indicate the effects of the present Example will be described. In the present experiment, the development ghost evaluation image described above, and a full solid image, were printed onto letter-size paper at a temperature of 23° C. and humidity of 50%, and the development ghost and solid image compliance defects were assessed.

The evaluation of development ghost was made by measuring the after-black half-tone image density and the after-white half-tone image density of the development ghost evaluation image described above, using an X-Rite Spectrodensitometer 500, and applying a ranking based on the following criteria, according to the difference in density therebetween.

A: Density difference in halftone image is less than 0.04

B: Density difference in halftone image is 0.04 or more and less than 0.08

C: Density difference in halftone image is 0.08 or more

The assessment of the solid image compliance defects was made by outputting a solid black image and making the following assessment of the difference in density between the leading end and the trailing end of the image, with an X-Rite Spectrodensitometer 500. A print test and an assessment image were output in monochrome.

A: Density difference between leading sheet edge and trailing sheet edge in full solid image is less than 0.2

B: Density difference between leading sheet edge and trailing sheet edge in full solid image is 0.2 or more and less than 0.3

C: Density difference between leading sheet edge and trailing sheet edge in full solid image is 0.3 or more As examples for comparing with the advantages of the present example, the same experiment was performed when the bias was controlled according to Comparative Examples 1-1, 1-2, and 1-3 illustrated in FIG. 3, and development ghost and solid image compliance defects were evaluated. In Comparative Examples 1-1 and 1-2, a constant bias were applied during a period from "start of development driving" to "stopping of development driving," and the experiment was performed by applying −500 V for Comparative Example 1-1 and −300 V for Comparative Example 1-2. Furthermore, in comparative example 1-3, the control according to the present invention was applied only for the first sheet of continuous printing, and a supply bias of −500V, which is the same as comparative example 1-1, was applied for the second sheet. In Table 1, the images of both of the two continuous prints were assessed jointly. In Table 2, the images were assessed separately on the first sheet and the second sheet of the continuous prints.

TABLE 1

| Image level of two sheets of continuous printing in each example | | |
|---|---|---|
| | Development ghost | Solid image compliance defects |
| Example 1 | A | A |
| Comparative Example 1-1 | C | A |
| Comparative Example 1-2 | A | C |

TABLE 2

| Image levels of first sheet and second sheet of continuous printing in each example | | | | |
|---|---|---|---|---|
| | First sheet of continuous printing | | Second sheet of continuous printing | |
| | Development ghost | Solid image compliance defects | Development ghost | Solid image compliance defects |
| Example 1 | A | A | A | A |
| Comparative Example 1-3 | A | A | C | A |

Firstly, the results in Table 1 will be explained. In the case where the control in comparative example 1-1 was carried out, more toner than necessary was supplied to the developing roller 4 during image formation, and the amount of toner recovered by the supply roller 5 was insufficient. As a result of this, the amount of charge on the after-white toner was increased, thereby raising the difference between the amount of charge on the after-black toner and the amount of charge on the after-white toner, and therefore development ghost occurred.

Furthermore, in the case where the control in comparative example 1-2 was carried out, the amount of development residue toner collected from the developing roller 4 was sufficient during image formation, and therefore the occurrence of development ghost could be reduced. However, since the amount of toner supplied from the supply roller 5 to the developing roller 4 during image formation was insufficient, then solid image compliance defects occurred in the full solid image.

Next, the results in Table 2 will be explained. In the case where the control of comparative example 1-3 was carried out, in the first sheet of continuous printing immediately after pre-rotation, the bias control according to the present practical example was carried out and therefore improvement in development ghost was observed. However, in the trailing end of the image of the first sheet of continuous printing, and thereafter, when the same bias control as comparative example 1-1 was carried out, a difference arose between the amount of charge on the after-white toner and the amount of charge on the after-black toner, and development ghost occurred.

In the second sheet of this continuous printing, the phenomenon of the occurrence of development ghost was marked in a co-rotating developing assembly in which the surfaces of the supply roller 5 and the developing roller 4 rotate in the same direction as each other in the contact region. In a co-rotating developing assembly, the capability for stripping collecting of the development residue toner on the developing roller 4, by the supply roller 5, is weak, as described previously, and therefore the level of development ghost is lower than in a counter-rotating developing assembly. Therefore, in a co-rotating developing assembly, it was necessary to adopt the bias control of the present Example, in the second and subsequent sheets of continuous printing also, and not only in the first sheet after the print preparation operation as described in Japanese Patent No. 5062183.

In the present Example, an example is described in which a position where the relative magnitudes of the supply bias and the developing bias are reversed during image formation, in other words, a position where the developing bias and the supply bias have equal potential, is provided at approximately the fourth rotation of the developing roller. This position is a position in the central portion (exact center) of the image in the direction of conveyance, in other words, a value where X is half the value of the dimension of the recording material in the conveyance direction thereof. The appropriate equipotential position of the developing bias and the supply bias changes with the toner holding capability of the supply roller 5, the fluidity of the toner or the electric resistance of the supply roller 5. For example, the amount of toner held increases, the greater the diameter and size of the foam cells of the supply roller 5. When using a developing assembly of this kind, the solid image compliance performance is improved, and therefore the equipotential position of the developing bias and the supply bias is controlled appropriately so as to be situated in the latter half portion of the image, and the development ghost can also be further improved. Furthermore, in a case where the use environment of the image forming apparatus has changed, the equipotential position of the developing bias and the supply bias which is suitable for achieving both development ghost and solid image compliance defects varies, and therefore the equipotential position is adjusted as appropriate.

According to the present invention which has been described in Example 1 above, it is possible to achieve both reduction of development ghost and prevention of solid image compliance defects which occur when using a developing assembly in which the respective surfaces of a developing roller and a supply roller move in the same direction. Therefore, it is possible to provide an image forming apparatus which is compatible with high image quality and long lifespan.

Example 2

The second practical example (Example 2) of the present invention describes an example in which both development positive ghost and solid image compliance defects are addressed in an environment of low-temperature and low-humidity conditions (temperature 15° C. and humidity 10%) where the level of development positive ghost is liable to become poor. The configuration in Example 2 improves the solid image compliance performance by using a regulating blade 8 having a curvature at the front end thereof. By improving the solid image compliance performance through using the regulating blade 8, the position at which the biasing direction of the toner is reversed in the image is controlled so as to be situated further towards the trailing end of the image, in comparison with Example 1. Consequently, the development positive ghost which becomes worse under low-temperature and low-humidity conditions is improved, and header following defects can be addressed. In the description of Example 2, the portions which overlap with Example 1 described above are omitted from the explanation.

In Example 2, the regulating blade 8 used was a conductive supporting body made of metallic SUS sheet steel as described in Japanese Patent Application Publication No.

2008-90160, on which a polyamide resin to which suitable conductive properties had been imparted was adhered as a laminate layer. The curvature R of the front end of the regulating blade 8 used in the present Example was 0.2 mm. By using a regulating blade in which the curvature R of the front end was 0.2 mm in this way, a beneficial effect in improving the solid image compliance performance in the co-rotating developing assembly was obtained, as disclosed in Japanese Patent Application Publication No. 2013-228636. For the resin, apart from polyamide, it is also possible to use polyethylene or polyester, or the like. Furthermore, it is also possible to adopt a configuration in which a prescribed curvature is applied to the actual SUS steel plate, rather than providing resin as described above. Moreover, in Example 2, the equipotential position of the developing bias and the supply bias is controlled so as to be situated in the latter half of the image (X=20 mm from the trailing end).

Figure 6:
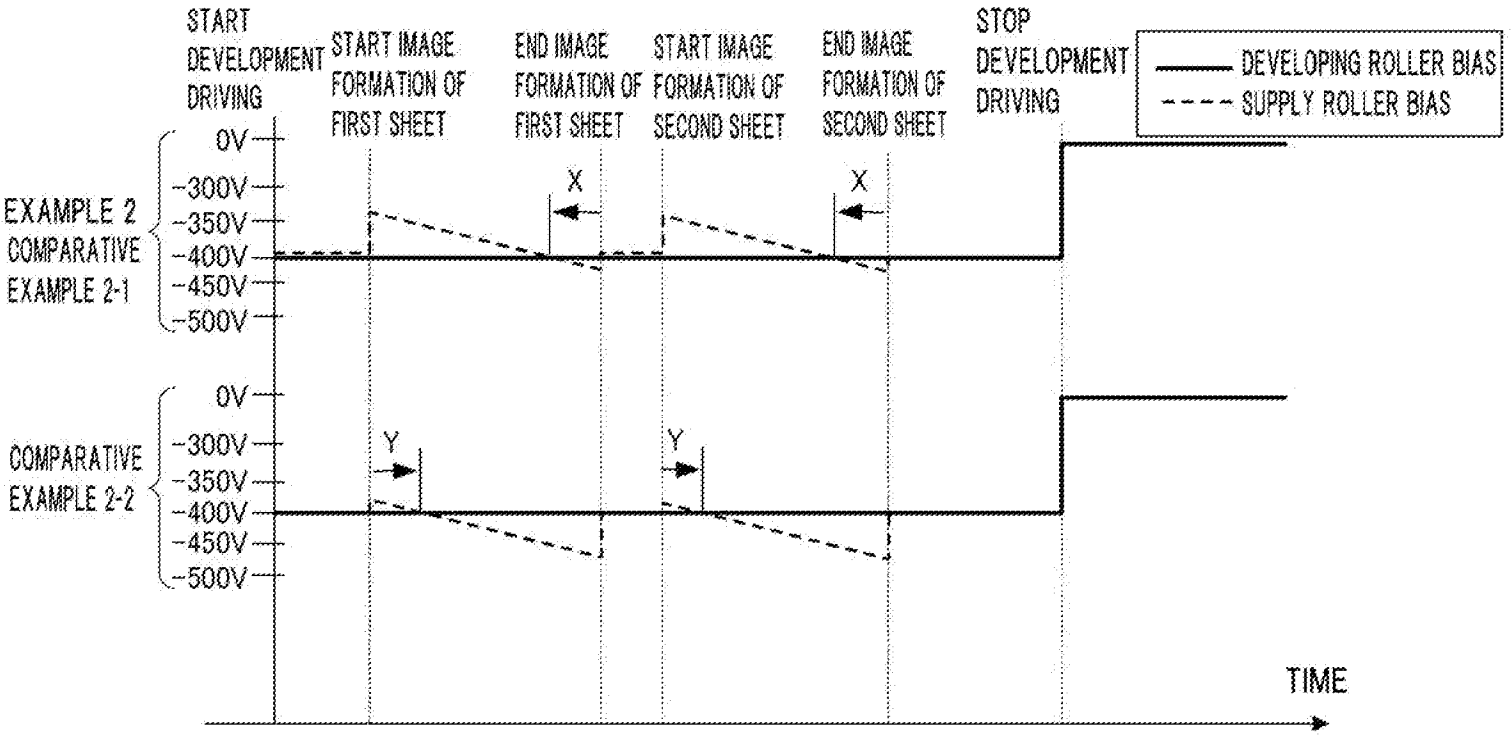
FIG. 6 is a timing chart of voltage control in Example 2 of the present invention.

In order to achieve the effects in Example 2, a similar experiment to that of Example 1 was carried out using comparative example 2-1 and comparative example 2-2. In comparative example 2-1, the same regulating blade 8 as that of Example 1 was used, in other words, a 0.1 mm-thick metallic SUS steel sheet which was not provided with a prescribed curvature (R=0.02 mm) at the front end thereof as in Example 2. Furthermore, in comparative example 2-1, the equipotential position of the developing bias and the supply bias was controlled so as to be situated in the central region of the image in the conveyance direction (the exact center of the conveyance direction of the recording material), similarly to Example 1. In comparative example 2-2, as shown in FIG. 6, the equipotential position of the developing bias and the supply bias is controlled so as to be situated in the front half portion of the image (Y from the leading end), in comparison with comparative example 2-1. The bias control in Example 2, comparative example 2-1 and comparative example 2-2 is shown in FIG. 6, and the experiment results are shown in Table 3. In Example 2, the level of ghost on the leading end side of the image and the level of ghost on the trailing end side of the image were evaluated jointly for a case (a) where the development ghost evaluation image described above was printed on the leading end side of the image, and a case (b) where the development ghost evaluation image was printed on the trailing end side of the image.

TABLE 3

Image level of two sheets of continuous printing in each example

| | Development ghost | | Solid image compliance |
|---|---|---|---|
| | (a) | (b) | defects |
| Example 2 R 0.20 mm | A | A | A |
| Comparative Example 2-1 R 0.02 mm | A | A | B |
| Comparative Example 2-2 R 0.20 mm | A | B | A |

In the Example 2, the development ghost and the solid image compliance defects where both good. As a result of this, the solid image compliance performance is improved by the effects of the regulating blade 8 which is used in the present Example, and solid image compliance defects are not liable to occur, even if the equipotential position of the developing bias and the supply bias is controlled so as to be situated in the latter half portion of the image. This is because, by setting the equipotential position of the developing bias and the supply bias to the latter half portion of the image, it is possible to raise the capability for stripping collecting of the development residue toner by the supply roller, up to the trailing end of the image, and both development positive ghost and solid image compliance can be addressed.

On the other hand, in comparative example 2-1, solid image compliance defects occurred. As a result of this, there is no improvement in the solid image compliance performance when using a regulating blade 8 having a small front end curvature R of 0.02 mm, and therefore the solid image compliance performance became worse due to controlling the equipotential position of the developing bias and the supply bias so as to be in the latter half portion of the image, similarly to Example 2.

Furthermore, in comparative example 2-2, the level of development ghost shown in Table 3 for (b) of the ghost evaluation image, in other words, the latter end of the image, became worse. This result is due to the fact that, although the solid image compliance performance is improved by the effects of the regulating blade 8, the equipotential position of the developing bias and the supply bias is controlled so as to be situated in the front half potion of the image.

According to the present invention which has been described in Example 2 above, it is possible to achieve both reduction of development ghost and prevention of solid image compliance defects which occur when using a developing assembly in which the respective surfaces of a developing roller and a supply roller move in the same direction. Therefore, it is possible to provide an image forming apparatus which is compatible with high image quality and long lifespan.

In the respective Examples described above, it is possible to employ a configuration which mutually combines the respective configurations. Furthermore, in the Example described above, a configuration is described in which the normal charging polarity of the toner is negative and the respective applied biases are negative, but it goes without saying that the present invention can also be applied to a configuration in which the normal charging polarity of the toner is positive and the respective applied biases are positive.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-052466, filed on Mar. 14, 2014, which is hereby incorporated by reference herein in its entirety.

What is claimed is:

1. An image forming apparatus forming an image on a recording material, comprising:

a developer bearing member, located in a developing chamber, that bears developer and develops an electrostatic latent image formed on an image bearing member;

a developing bias application unit that applies a developing bias to the developer bearing member;

a developer supply member that makes contact with the developer bearing member in a contact region and supplies the developer to the developer bearing member in the developing chamber;

a developer accommodating chamber which is located below the developing chamber and has a developer conveying member for conveying the developer to the developing chamber; and a supply bias application unit that applies a supply bias to the developer supply member, wherein the developer bearing member and the developer supply member move in the same direction in the contact region, wherein during an image formation period from a start of image formation until an end of image formation in an image forming operation for forming an image on one recording material, the developing bias application unit applies a developing bias to the developer bearing member and the supply bias application unit applies a supply bias to the developer supply member so that, at the start of image formation, an absolute value of the developing bias is greater than an absolute value of the supply bias, and in a center or latter half of the image formation period, the developing bias and the supply bias have equal potential, and then the absolute value of the developing bias becomes smaller than the absolute value of the supply bias, until the end of image formation.

2. The image forming apparatus according to claim 1, wherein during the image formation period, the developing bias application unit applies a developing bias to the developer bearing member and the supply bias application unit applies a supply bias to the developer supply member such that a difference between a magnitude of the developing bias and a magnitude of the supply bias changes gradually.

3. The image forming apparatus according to claim 1, wherein during the image formation period, the developing bias application unit applies a developing bias of uniform magnitude to the developer bearing member; and the supply bias application unit applies a supply bias, a magnitude of the absolute value of which changes gradually, to the developer supply member.

4. The image forming apparatus according to claim 1, wherein during the image formation period, a polarity of an amount of change per unit time of the supply bias which is applied by the supply bias application unit is the same as a normal charging polarity of the developer.

5. The image forming apparatus according to claim 1, wherein during the image formation period, an amount of change per unit time of the supply bias which is applied by the supply bias application unit is uniform.

6. The image forming apparatus according to claim 1, wherein during the image formation period, an amount of change per unit time of the supply bias which is applied by the supply bias application unit is changed at least once.

7. The image forming apparatus according to claim 1, wherein during the image formation period, an amount of change per unit time of the supply bias which is applied by the supply bias application unit is changed stepwise.

8. The image forming apparatus according to claim 1, wherein a period, apart from the image formation period of an image forming operation for forming an image on one recording material, includes a period during which the developing bias application unit applies a developing bias to the developer bearing member and the supply bias application unit applies a supply bias to the developer supply member, such that the developing bias and the supply bias have the same potential.

9. The image forming apparatus according to claim 1, wherein, in a case where images are formed in continuous fashion on a plurality recording material, a period from the end of image formation in an image formation operation for forming an image on a first recording material until the start of image formation in an image formation operation for forming an image on a second recording material that follows the first recording material includes a period during which the supply bias application unit applies a supply bias of a magnitude such that a polarity of the magnitude of the supply bias with respect to the developing bias becomes opposite to a normal charging polarity of the developer.

10. The image forming apparatus according to claim 1, further comprising a developer amount regulating member that contacts the developer bearing member and regulates an amount of the developer borne on the developer bearing member, wherein the developer amount regulating member has a curvature of a prescribed magnitude on a front end of a free end thereof, and a portion having the curvature of the prescribed magnitude is configured so as to contact the developer bearing member.

11. The image forming apparatus according to claim 1, wherein the supply bias application unit applies a bias which is divided, via a bipolar transistor, from a power source of a charging bias which is applied to the image bearing member.

12. The image forming apparatus according to claim 1, wherein the image formation period is an image formation period for forming an image on a second and subsequent sheets of recording material.

13. An image forming apparatus forming an image on a recording material, comprising:

a developer bearing member, located in a developing chamber, that bears developer and develops an electrostatic latent image formed on an image bearing member;

a developing bias application unit that applies a developing bias to the developer bearing member;

a developer supply member that is provided so as to make contact with the developer bearing member in a contact region and supplies a developer to the developer bearing member in the developing chamber;

a developer accommodating chamber which is located below the developing chamber and has a developer conveying member for conveying the developer to the developing chamber; and a supply bias application unit that applies a supply bias to the developer supply member, wherein the developer bearing member and the developer supply member move in the same direction in the contact region, wherein during an image formation period from a start of image formation until an end of image formation in an image forming operation for forming an image on one recording material, the developing bias application unit applies a developing bias to the developer bearing member and the supply bias application unit applies a supply bias to the developer supply member such that a biasing force causing the developer to move from the developer supply member towards the developer bearing member increases gradually and acts on the developer in the contact region between the developer bearing member and the developer supply member.

14. An image forming apparatus, comprising:

a developer bearing member, located in a developing chamber, that forms a developer image by developing an electrostatic latent image formed on an image bearing member;

a developer supply member that contacts with the developer bearing member in a contact region and supplies a developer to the developer bearing member in the developing chamber;

a developer accommodating chamber which is located below the developing chamber and has a developer conveying member for conveying the developer to the developing chamber; and wherein the developer bearing member and the developer supply member move in the same direction in the contact region, during an image formation period from a start of image formation until an end of image formation in an image forming operation for forming an image on one recording material, a developing bias is applied to the developer bearing member and a supply bias is applied to the developer supply member, such that, at the start of image formation, an absolute value of the developing bias is greater than the absolute value of the supply bias, and in a center or latter half of the image formation period, the developing bias and the supply bias have equal potential, and then the absolute value of the developing bias becomes smaller than the absolute value of the supply bias, until the end of image formation.

15. A process cartridge, comprising:

a developer bearing member, located in a developing chamber, that forms a developer image by developing an electrostatic latent image formed on an image bearing member;

a developer supply member contacts with the developer bearing member in a contact region and supplies a developer to the developer bearing member; and a developer accommodating chamber which is located below the developer chamber and has a developer conveying member for conveying the developer to the developing chamber, wherein the developer bearing member and the developer supply member move in the same direction in the contact region, and wherein during an image formation period from a start of image formation until an end of image formation in an image forming operation for forming an image on one recording material, a developing bias is applied to the developer bearing member and a supply bias is applied to the developer supply member, such that, at the start of image formation, an absolute value of the developing bias is greater than an absolute value of the supply bias, and in a center or latter half of the image formation period, the developing bias and the supply bias have equal potential, and then the absolute value of the developing bias becomes smaller than the absolute value of the supply bias, until the end of image formation.

16. An image forming apparatus forming an image on a recording material, comprising:

a developer bearing member that bears developer and develops an electrostatic latent image formed on an image bearing member;

a developing bias application unit that applies a developing bias to the developer bearing member;

a developer supply member that makes contact with the developer bearing member in a contact region and supplies the developer to the developer bearing member; and a supply bias application unit that applies a supply bias to the developer supply member, wherein the developer bearing member and the developer supply member move in the same direction in the contact region, wherein during an image formation period from a start of image formation until an end of image formation in an image forming operation for forming an image on one recording material, the developing bias application unit applies a developing bias to the developer bearing member and the supply bias application unit applies a supply bias to the developer supply member so that, at the start of image formation, an absolute value of the developing bias is greater than an absolute value of the supply bias, and in a center or latter half of the image formation period, the developing bias and the supply bias have equal potential, and then the absolute value of the developing bias becomes smaller than the absolute value of the supply bias, until the end of image formation, wherein the supply bias application unit applies a bias which is divided, via a bipolar transistor, from a power source of a charging bias which is applied to the image bearing member.

17. An image forming apparatus forming an image on a recording material, comprising:

first and second developer bearing members that bear developer having a negative polarity and develop first and second electrostatic latent images formed on first and second image bearing members, respectively;

first and second developing bias application units that apply first and second developing biases having a negative polarity to the first and second developer bearing members, respectively;

first and second developer supply members that make contact with the first and second developer bearing members in first and second contact regions, respectively, and supply the developer to the first and second developer bearing members, respectively; and first and second supply bias application units that apply first and second supply biases to the first and second developer supply members, wherein the first and second developer bearing members and the first and second developer supply members move in the same direction in the first and second contact regions, respectively, wherein during an image formation period from a start of image formation until an end of image formation in an image forming operation for forming an image on one recording material, (i) at the start of image formation, an absolute value of the first developing bias is greater than an absolute value of the first supply bias, and (ii) in a center or latter half of the image formation period, the first developing bias and the first supply bias have equal potential, and (iii) then the absolute value of the first developing bias becomes smaller than the absolute value of the first supply bias, until the end of image formation, wherein during an image formation period from a start of image formation until an end of image formation in an image forming operation for forming an image on one recording material, (i) at the start of image formation, the second developing bias and the second supply bias have equal potential or the absolute value of the second developing bias becomes smaller than the absolute value of the second supply bias, until the end of image formation and (ii) then in a latter half, the absolute value of the second developing bias becomes smaller than the absolute value of the second supply bias, until the end of image formation.

* * * * *